US005845900A

United States Patent [19]

Greive

[11] Patent Number: 5,845,900

[45] Date of Patent: Dec. 8, 1998

[54] APPARATUS FOR SHEET SINGLING AND ALIGNMENT ON THE TOP SIDE OF A SHEET PILE

[75] Inventor: Martin Greive, Heidelberg, Germany

[73] Assignee: Heidelberger Druckmaschinen AG, Heidelberg, Germany

[21] Appl. No.: 289,691

[22] Filed: Aug. 12, 1994

[30] Foreign Application Priority Data

Aug. 12, 1993 [DE] Germany ..... 43 27 018.2
Mar. 7, 1994 [DE] Germany ..... 44 07 505.7

[51] Int. Cl.[6] ..... B65H 3/14

[52] U.S. Cl. ..... 271/98; 271/105; 271/31; 271/240

[58] Field of Search ..... 271/98, 105, 107, 271/108, 30.1, 31, 240, 248, 253, 254

[56] References Cited

U.S. PATENT DOCUMENTS 3,061,303 10/1962 Glaser et al. ..... 271/240
3,861,668 1/1975 Wood ..... 271/105
3,938,800 2/1976 Wirz ..... 271/98
3,977,672 8/1976 Godlewski ..... 271/30.1
5,137,267 8/1992 Wirz et al. ..... 271/98

FOREIGN PATENT DOCUMENTS 300514 9/1917 Germany .
2906900 9/1980 Germany .
3616804 2/1991 Germany .

*Primary Examiner*—H. Grant Skaggs
*Attorney, Agent, or Firm*—Herbert L. Lerner; Laurence A. Greenberg

[57] ABSTRACT

Apparatus for sheet singling and alignment on a top side of a sheet pile of a rotary printing press includes a suction device extending transversely to sheet transport direction in the vicinity of the leading edge of the sheet pile, the suction device being intermittently activatable with suction air, a scanning device for controlling a lifting motion of the sheet pile, the scanning device extending across the entire width of the pile and having a member movable towards and away from the top side of the pile for scanning the height thereof, swivelable levers adjacent the pile-height scanning member, an element for laterally aligning single sheets of the sheet pile axially displaceably mounted on the swivelable levers, and a device for directing an air stream onto the leading edge of the sheet pile so as to lift off a leading-edge region of the respective single sheets from the pile.

13 Claims, 9 Drawing Sheets

APPARATUS FOR SHEET SINGLING AND ALIGNMENT ON THE TOP SIDE OF A SHEET PILE

SPECIFICATION

The invention relates to an apparatus for sheet singling and alignment on the top side of a sheet pile of a rotary printing press, with a suction device extending transversely to.the transport direction in the vicinity of the leading edge of the pile of sheets, the suction device being intermittently activatable with suction air, and with a scanning device, the scanning device controlling the lifting motion of the pile of sheets and extending across the entire width of the pile and being movable towards the top side of the pile and away therefrom, with means for directing an air stream onto the leading edge of the pile so as to lift off a leading-edge region of a single sheet from the pile.

Published German Patent Document DE 29 06 900 Al discloses a control system for a lifting motion of a pile table of sheet-processing machines. A two-armed sensing lever disposed at the front or leading side of a pile of sheets is equipped with one sensing arm which can be brought into contact with the top front or leading edge of the pile of sheets, while the other arm of the sensing lever, acting as a switching arm, actuates a lifting switch. In this arrangement of the prior art, however, no consideration is given to the alignment of the sheets while they are still in the pile region.

Published German Patent Document DE 36 16 804 C2 describes a sheet-singling or separating device. This construction in the state of the prior art discloses juxtaposed wire clips which are attached to a shaft journalled in levers. Those sections of the wire clips which rest on the uppermost sheet of the pile of sheets transport the sheets to be singled cyclically in accordance with the swiveling motions of the levers. A suction drum applies suction to the respective sheet so as to grip and transport it into a nip between the suction drum and transport rollers, which forward the sheet to further-transporting devices. The lateral alignment of a sheet on the top side of a pile is also not disclosed in this construction of the prior art.

Proceeding from the prior art constructions outlined hereinabove, it is an object of the invention to provide an apparatus for sheet singling and alignment on the top side of a sheet pile wherein the lateral alignment of sheets to be singled or separated on the pile may be realized without additional disrupting internal components.

With the foregoing and other objects in view, there is provided, in accordance with the invention, an apparatus for sheet singling and alignment on a top side of a sheet pile of a rotary printing press, comprising a suction device extending transversely to sheet transport direction in the vicinity of the leading edge of the sheet pile, the suction device being intermittently activatable with suction air, a scanning device for controlling a lifting motion of the sheet pile, the scanning device extending across the entire width of the pile and having a member movable towards and away from the top side of the pile for scanning the height thereof, swivelable levers adjacent the pile-height scanning member, an element for laterally aligning single sheets of the sheet pile axially displaceably mounted on the swivelable levers, and means for directing an air stream onto the leading edge of the sheet pile so as to lift off a leading-edge region of the respective single sheets from the pile.

In accordance with another feature of the invention, the element for laterally aligning the single sheets is shaped as a rod and is at least partly provided with a friction coating.

In accordance with a further feature of the invention, the apparatus includes side walls, profiled elements mounted in the side walls, and rounded contact heads formed at respective end regions of the rod-shaped aligning element, the contact heads being in cooperative engagement with the profiled elements during a swiveling movement of the swivelable levers.

In accordance with an added feature of the invention, the pile-height scanning member has respective ends penetrating the swivelable levers, and including respective bearings mounted on the ends of the scanning member.

In accordance with an additional feature of the invention, the bearings support the aligning member, and are disposed so as to be rotatable about a center point of the scanning member.

In accordance with yet another feature of the invention, the apparatus includes a spring-loadable adjusting device for varying contact force between the aligning member and an uppermost single sheet of the sheet pile.

In accordance with yet a further feature of the invention, the apparatus includes two side stops between which the single sheets in the upper region of the sheet pile are disposable, the side stops being positionable for matching the format of the respective single sheets.

In accordance with yet an added feature of the invention, the profiled elements are roller carriers carrying a plurality of cylindrical bodies disposed above one another, at least one of the cylindrical bodies being offset with respect to an imaginary plane extending through the others of the cylindrical bodies.

In accordance with yet an additional feature of the invention, the apparatus includes a yoke, the roller carriers being interconnected at the side walls through the intermediary of the yoke.

In accordance with still another feature of the invention, two cylindrical bodies are disposed so as to protrude with respect to the vertical, on one of the roller carriers and, on another of the roller carriers, one cylindrical body is vertically protrudingly disposed with respect to the remaining cylindrical bodies.

In accordance with still a further feature of the invention, the profiled elements are cams.

In accordance with still an added feature of the invention, the apparatus includes an adjusting mechanism for effecting a fine adjustment of the profiled elements in vertical direction.

In accordance with still an additional feature of the invention, the apparatus includes an adjusting unit for vertically displacing the profiled elements so that a lateral aligning movement of the aligning element is changed over.

In accordance with another feature of the invention, the adjusting unit is formed of connecting linkages respectively associated with the corresponding profiled elements, the connecting linkages being interconnected through the intermediary of a control shaft.

In accordance with a concomitant feature of the invention, the apparatus includes an indicating element for indicating a current setting of the profiled elements.

The advantages achievable with the invention are of a manifold nature. Firstly, the integration of the lateral alignment operation into the previously existing pile-height scanning operation makes it possible to keep the number of components very small, which reduces costs. Furthermore, the swiveling motion towards the top side of the pile of sheets is used, apart from determining the pile height, also for lateral alignment, with the result that two functions take place simultaneously and there is no loss of time. The aligning table can be dispensed with entirely, because correctly aligned sheets are transferred from suckers to transport rollers which further transport the sheets.

In an advantageous embodiment, as noted, the element laterally aligning the single sheets is in the shape of a rod and is provided with a friction coating or at least, however, with rings of a suitable material. At its end regions, the element laterally aligning the sheets is formed with rounded contact heads, which initiate the aligning motion. The member scanning the pile of sheets has bearings at the ends thereof which penetrate the swivelable levers, the aligning member being held in the bearings and being rotatable about the scanning bar. This results in a compact construction and provides relatively easy visual access to the top edge of the sheet pile.

In a further advantageous embodiment of the invention, the contact force of the aligning member against the uppermost single sheet of the pile of sheets is variable through the intermediary of a spring-loaded adjusting device. This permits an adaptation to different printing stocks, either heavy or light in weight.

The single sheets in the upper region of the pile of sheets, during their upwardly-directed lifting motion, come between two side stops which are positionable to suit or match the size or format of the sheet.

In order to initiate the lateral alignment of the single sheets during the downwardly-directed swiveling motion, vertically displaceable contoured or profiled elements are held at the side walls next to the pile of sheets, the contoured or profiled elements cooperating with the end regions of the aligning member. According to an advantageous embodiment of the invention, the contoured or profiled elements are roller carriers. Held in the roller carriers is a plurality of cylindrical bodies disposed above one another, with at least one of the cylindrical bodies being offset with respect to an imaginary plane extending through the remaining or other cylindrical bodies. For simultaneous adjustment of both roller carriers in the vertical direction at the side walls, the roller carriers are interconnected through the intermediary of a yoke.

Finally, on one roller carrier, two cylindrical bodies are projectingly oriented with respect to the vertical whereas, on the other roller carrier, one cylindrical body is vertically protrudingly oriented with respect to the remaining or other cylindrical bodies. This finally makes it possible to change over the axial lateral aligning motion of the aligning member to the side stop at the operator-side and the drive-side, respectively.

According to an advantageous different embodiment of the contoured or profiled elements, they are in the form of cams. In order to achieve the aforedescribed aligning effect, the cams have a contour or profile which basically reproduces the contour or profile of the forward and backward-set rollers. It is advantageous for the cams to be injection-molded plastic parts. The use of the cams instead of the rollers held in the roller carriers provides, firstly, a simpler and thus lower-cost construction; secondly, the use of cams instead of the rotatably held rollers results in a considerable reduction in noise.

According to an advantageous further development of the apparatus according to the invention, use is made of an adjusting mechanism which permits a fine adjustment of the vertically displaceable contoured or profiled elements. The vertical displacement of the elements makes it possible to vary the starting time of the lateral motion of the aligning member within an adjustment range of approximately 1 mm.

This adjustment facility makes it possible optimally to match the apparatus according to the invention to the thickness of the particular sheets to be printed.

Furthermore, an advantageous further development of the device according to the invention provides for an adjusting unit which vertically displaces the contoured or profiled elements in such a manner that the lateral aligning motion of the aligning member is changed over. In particular, the adjusting unit is formed of connecting linkages respectively associated with the corresponding contoured or profiled element, the two connecting linkages being interconnected through the intermediary of a control shaft. In order to achieve trouble-free operation of the adjusting unit, the change-over itself is accomplished by a simple rotation of the control shaft.

Indicating elements are included in the apparatus of the invention in order to provide a visual indication of the currently selected height setting and/or of the instantaneously set lateral aligning motion of the aligning member.

Other features which are considered as characteristic for the invention are set forth in the appended claims.

Although the invention is illustrated and described herein as embodied in an apparatus for sheet singling and alignment on the top of a sheet pile, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 5:
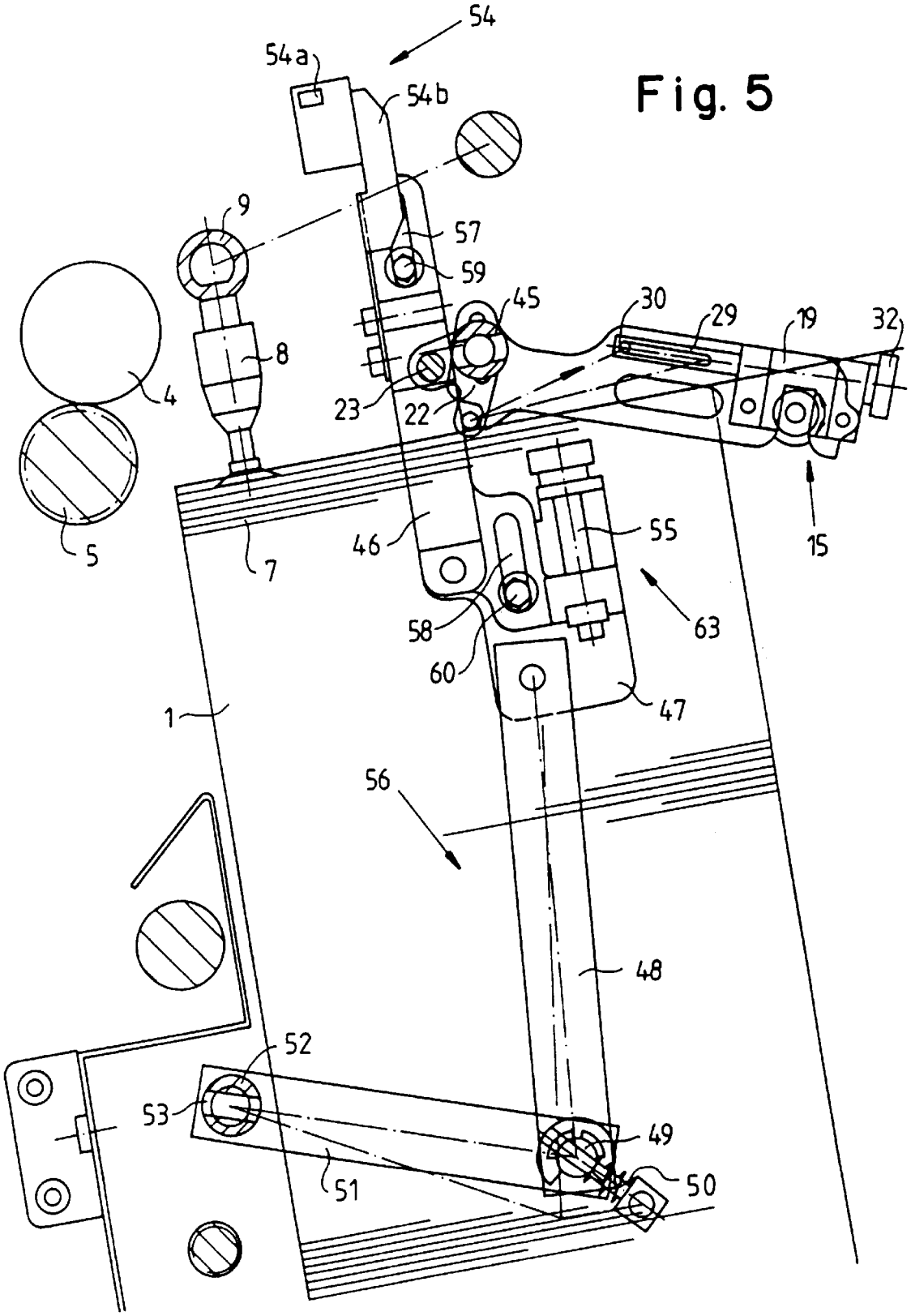
FIG. 5 is a side elevational view of another embodiment of the apparatus according to the invention.
Figure 6:
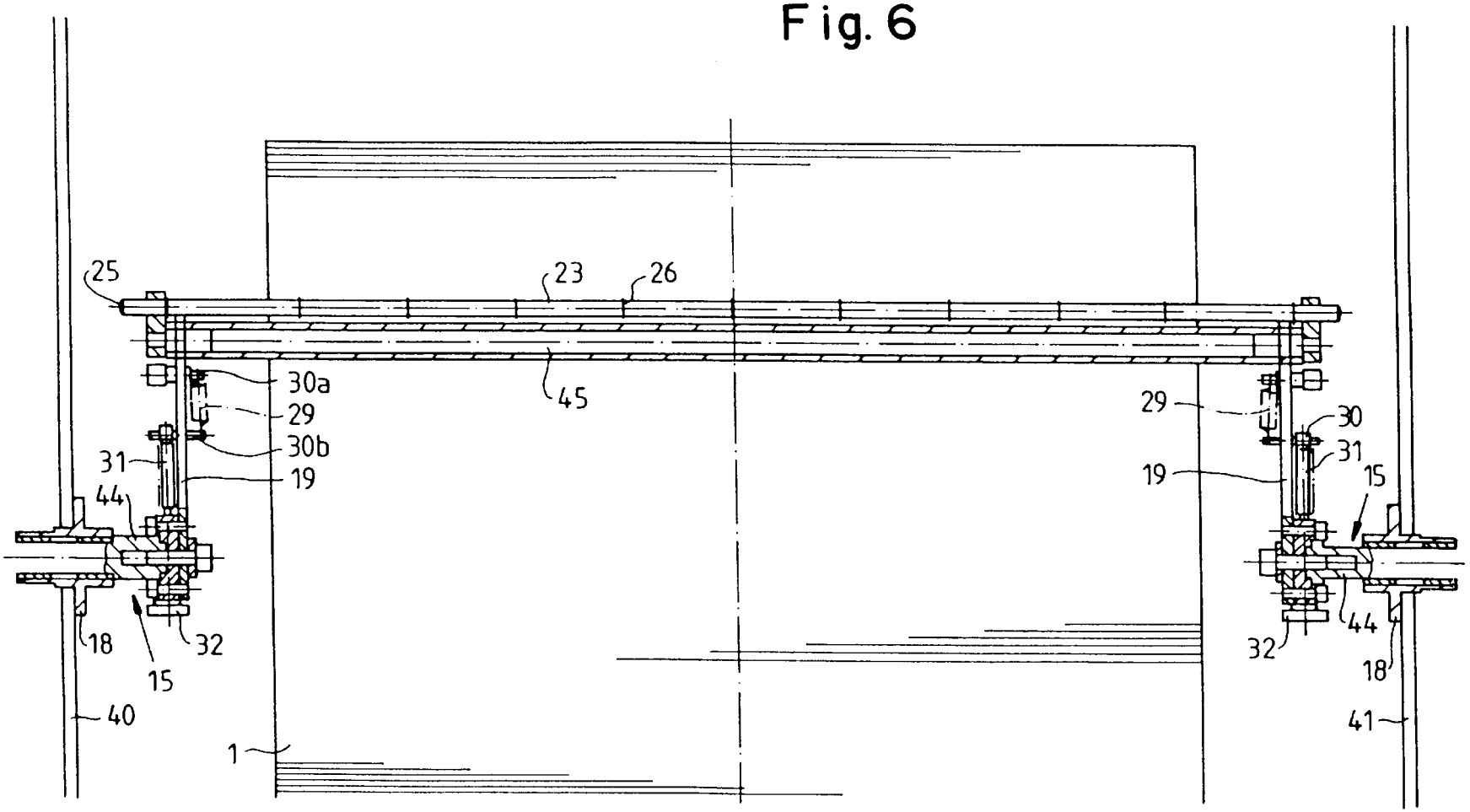
FIG. 6 is a fragmentary longitudinal sectional view of the embodiment of the invention according to FIG. 5.
Figure 6A:
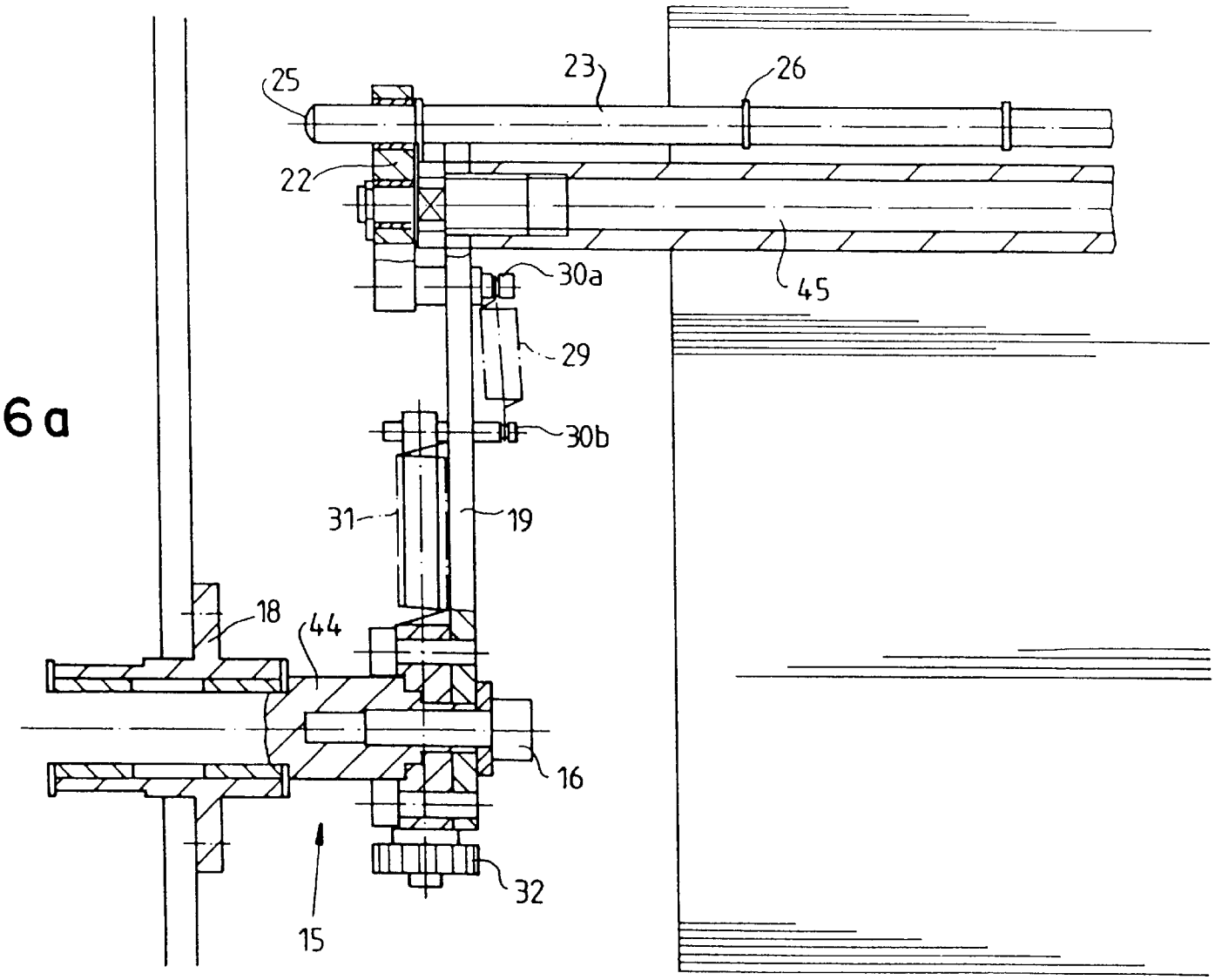
Figure 7:
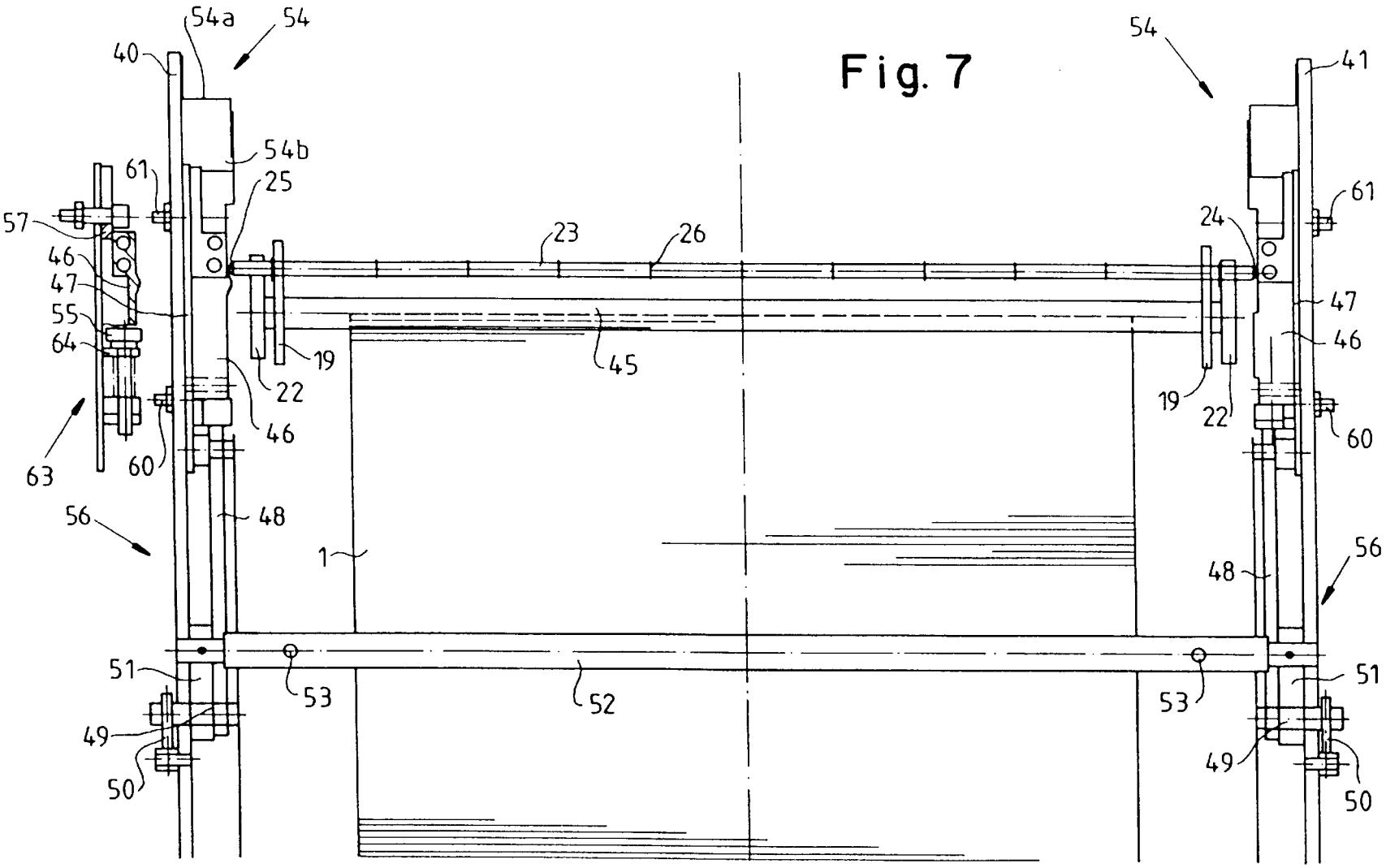
Figure 7A:
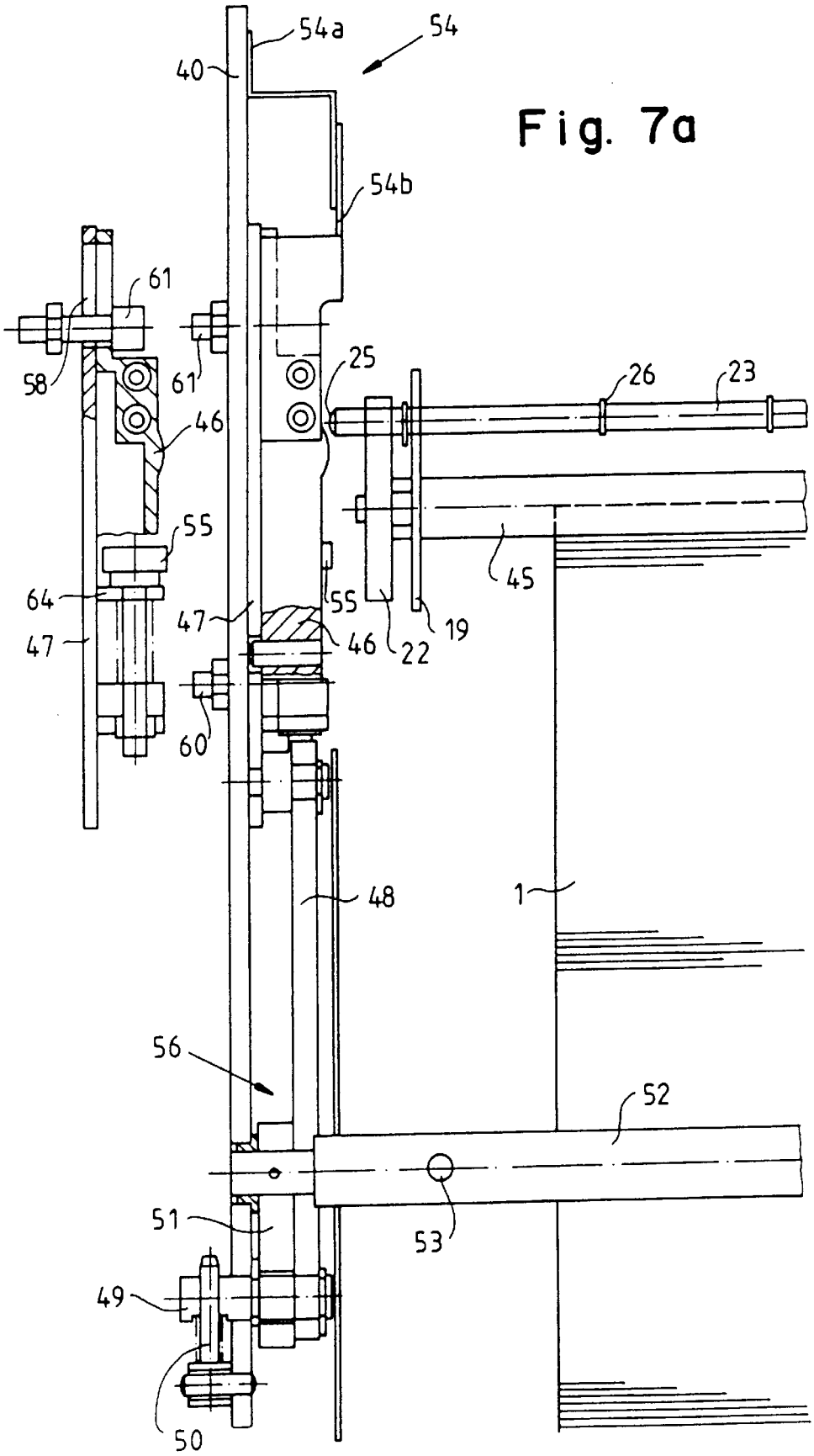

FIG. 6*a* is an enlarged fragmentary view of FIG. 6;

FIG. 7 is a front elevational view of the embodiment according to FIG. 5; and FIG. 7*a* is an enlarged fragmentary view of FIG. 7.

Figure 1:
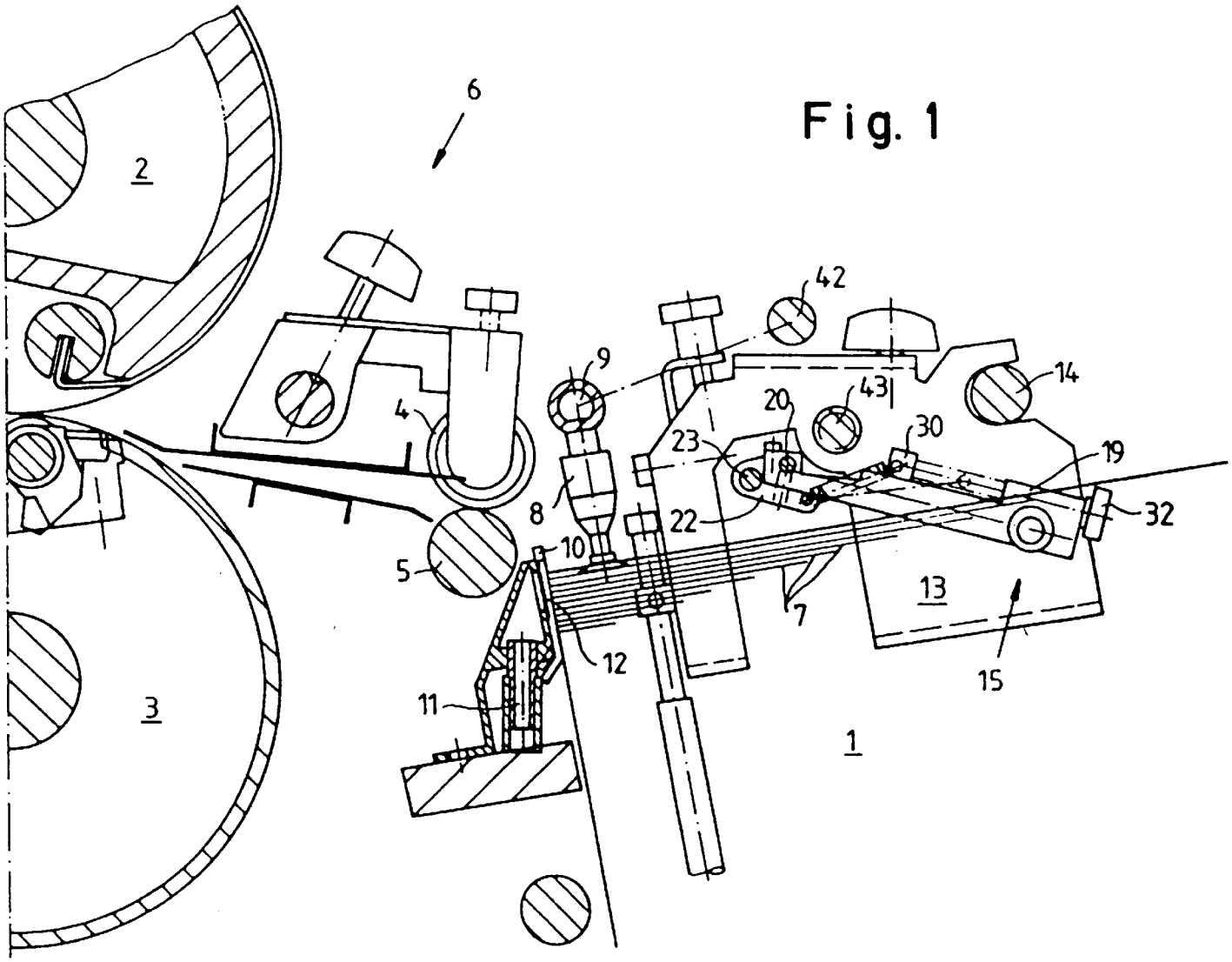
FIG. 1 is a side elevational view, partly in section, of printing-unit cylinders together with suction devices and aligning components above a sheet pile in accordance with the apparatus of the invention.

Referring now to the drawings and, first, particularly to FIG. 1 thereof, there are shown therein printing-unit cylinders together with suction devices and aligning components above a sheet pile.

Single sheets 7 are supplied from a sheet pile 1 to an impression cylinder 3, on which they are printed by a transfer cylinder 2. Provided above the sheet pile 1 are suckers 8, which are attached to a suction bar 9 and introduce the single sheets 7 into a nip between transport rollers 4 and 5. The upper transport roller 4 is part of an adjusting device 6, by means of which the nip between the transport rollers 4 and 5 can be adapted to different thicknesses of stock. A fanning blower 11 is accommodated on a cross-member at the front or leading edge of the sheet pile 1. The fanning air, which passes an air outlet 12, assists in the singling or separating of the upper sheets 7 on the sheet pile 1.

Figure 2:
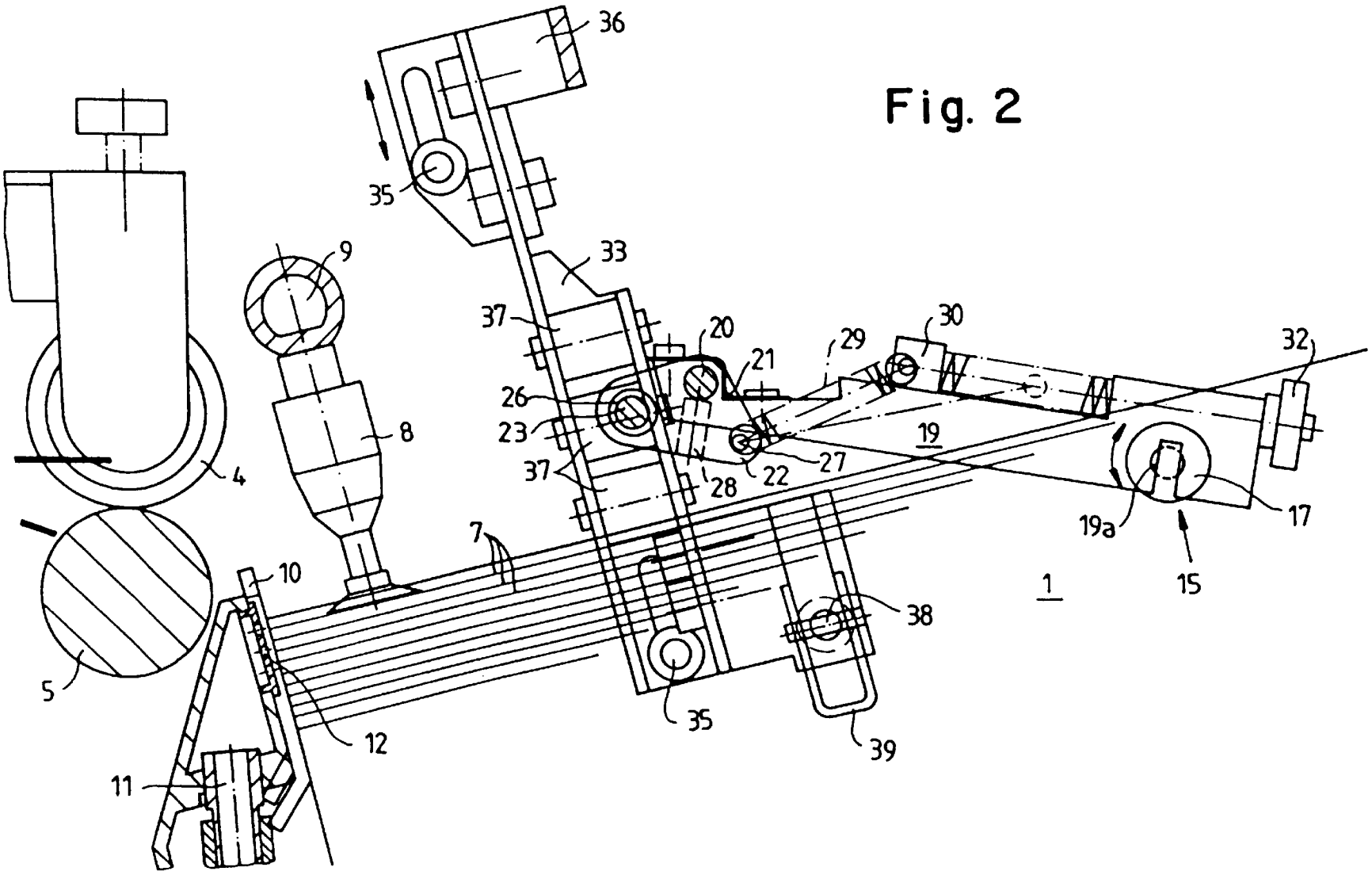
FIG. 2 is an enlarged fragmentary view of FIG. 1 in another operating phase of the apparatus according to the invention, and showing swivelable levers with a vertically displaceable roller carrier.

An adjusting spindle 43, which extends across the width of the sheet pile 1, penetrates the side stops 13 in such a manner that, when the adjusting spindle 43 is rotated, the side stops 13 are axially displaceable on a cross-member 14. Held on a journal bearing 15 between the side stops 13 and non-illustrated side walls are swivelable levers 19 which, in turn, accommodate a scanning bar 20, by means of which the height of the sheet pile 1 is scanned in time or in synchronism with the press. Further provided on the levers 19 are swivelable bearings 22 which, in turn, accommodate an aligning member 23. The contact force of the bearings 22, and thus of the aligning member 23, against the uppermost of the single sheets 7 is individually adjustable through the intermediary of a diagrammatically represented spring 29 (FIG. 2). For this purpose, the preloading of the diagrammatically represented spring 29 is influenced by a knurled screw 32, which acts on a push rod 30 through the intermediary of an anti-rotation protective element 31. The upper connection point of the spring 29 is accommodated on the push rod 30 and consequently follows the displacement motion of the push rod 30 on the swivel lever 19.

FIG. 2 provides a detailed representation of the swivelable levers together with a vertically displaceable roller carrier.

A journal bearing 15 includes respective journals 17 (FIG. 2) and 42 (FIG. 1) through which the swivelable levers 19 are held in the side walls. By means of the springs 29, the preloading of the bearings 22 on the levers 19 can be adapted to different stocks or paper thicknesses, as stated hereinbefore. Mounted above the scanning bar 20, which is held by the two swivelable levers 19, is a contoured cross-member 21, which connects the levers 19. Provided on the bearing 22 is a journal 27, which represents the lower connection point of the spring 29. The aligning member 23, which is held in the bearing 22, is surrounded by a friction coating 26; the scanning bar 20 is located in the bearing 22 by means of a setscrew 28.

FIG. 2 further shows a substantially vertically extending roller carrier 33. The roller carrier 33 is guided as a whole in oblong holes or slots through the intermediary of adjusting screws 35 and is vertically adjustable in two steps. The guidance of the roller carriers 33 and 34 on the adjusting screws 35 prevents the roller carriers 33 and 34 from tilting. The illustrated roller carrier 33 is connected by a yoke 36 to its counterpart 34 (which, however, is not shown in FIG. 2). Held above one another in the contours or profiles of the roller carrier 33 are three journals, which respectively accommodate a cylindrical body 37, which are rollers, for example, in this case. Instead of the rollers shown in the roller carriers 33 and 34, it is also possible for each of the roller carriers 33 and 34 to accommodate a cam, by means of which the aligning member can be actuated. Formed at the lower end of the roller carrier 33 is a U-bolt 39, which is provided with a locking pin 38. A vertical displacement of the roller carriers 33 and 34 is not possible until after the removal of the unlocking pin 38, which engages in holes formed in the side walls 40 and 41. Accordingly, the roller carriers 33 and 34 are locked at the appropriate working height by means of the locking pins 38.

Figure 3:
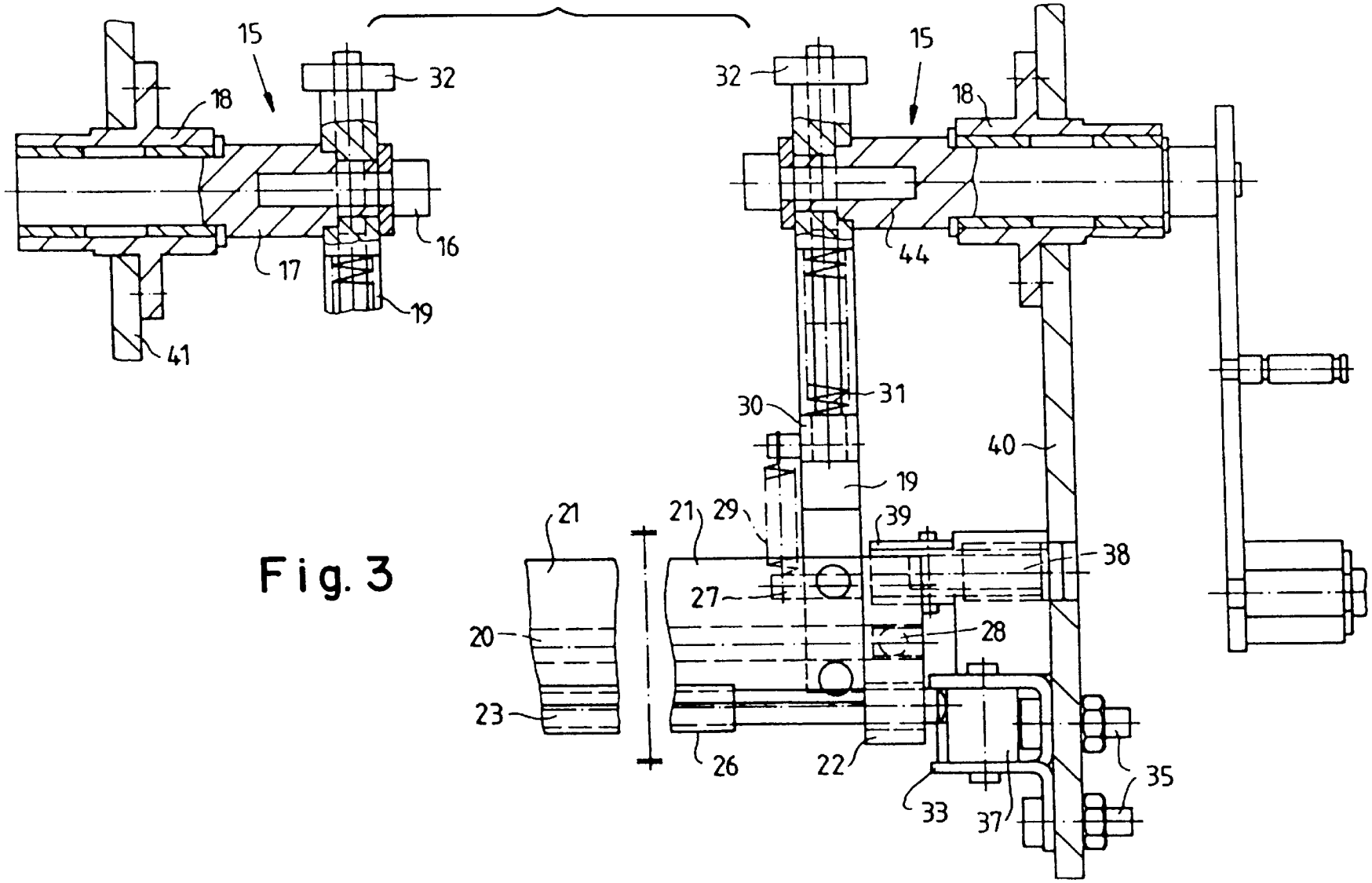
FIG. 3 is a partly broken-away longitudinal sectional view of FIG. 2 taken through side walls, swivelable levers and roller carriers thereof.

FIG. 3 is a fragmentary longitudinal sectional view taken through side walls, journal bearings and the swivelable levers.

The journal bearings 15 include a respective bushing 18, which is bolted to a side wall 40 or 41. The journal 44 is axially fixed to a plain or sliding bearing in the bushing 18. In order to attach the levers 19 on the journals 17 and 44, respectively, the levers 19 are provided with a rectangular cutout **19*a* which is engaged by a corresponding mating piece on the journals 17 and 44, respectively. After the bolts 16 have been loosened, the levers 19, which are interconnected through the intermediary of the contoured or profiled cross-member 21, can be removed from above together with the bearing 22 and the scanning bar 20**.

Both swivelable levers 19 accommodate knurled screws 32, which, respectively, through the intermediary of an anti-rotation or anti-torsion protective element 31, influence the displacement of the push rods 30. Thus, the spring tension acting upon the journal 27 of the bearings 22 can be metered. The scanning bar 20 is non-rotatably clamped in the bearing 22 through the intermediary of the setscrew 28; it is, however, rotatably held in the swivelable lever 19. The aligning member 23 provided with the friction coating 26 is laterally displaceably held in the bearings 22, of which, for reasons of symmetry, only one is shown. The lateral displacement of the aligning member 23 is accomplished due to the penetration of the bearings 22 by the ends of the aligning member 23, as well as by the cylindrical bodies 37, which are disposed one above the other in the roller carriers 33 and 34. The yoke 36 connecting the roller carriers 33 and 34 has been omitted from FIG. 3 in the interest of improved clarity. The function of the locking pin 38 and the U-bolt 39 has been discussed hereinbefore in connection with FIG. 2.

Figure 4:
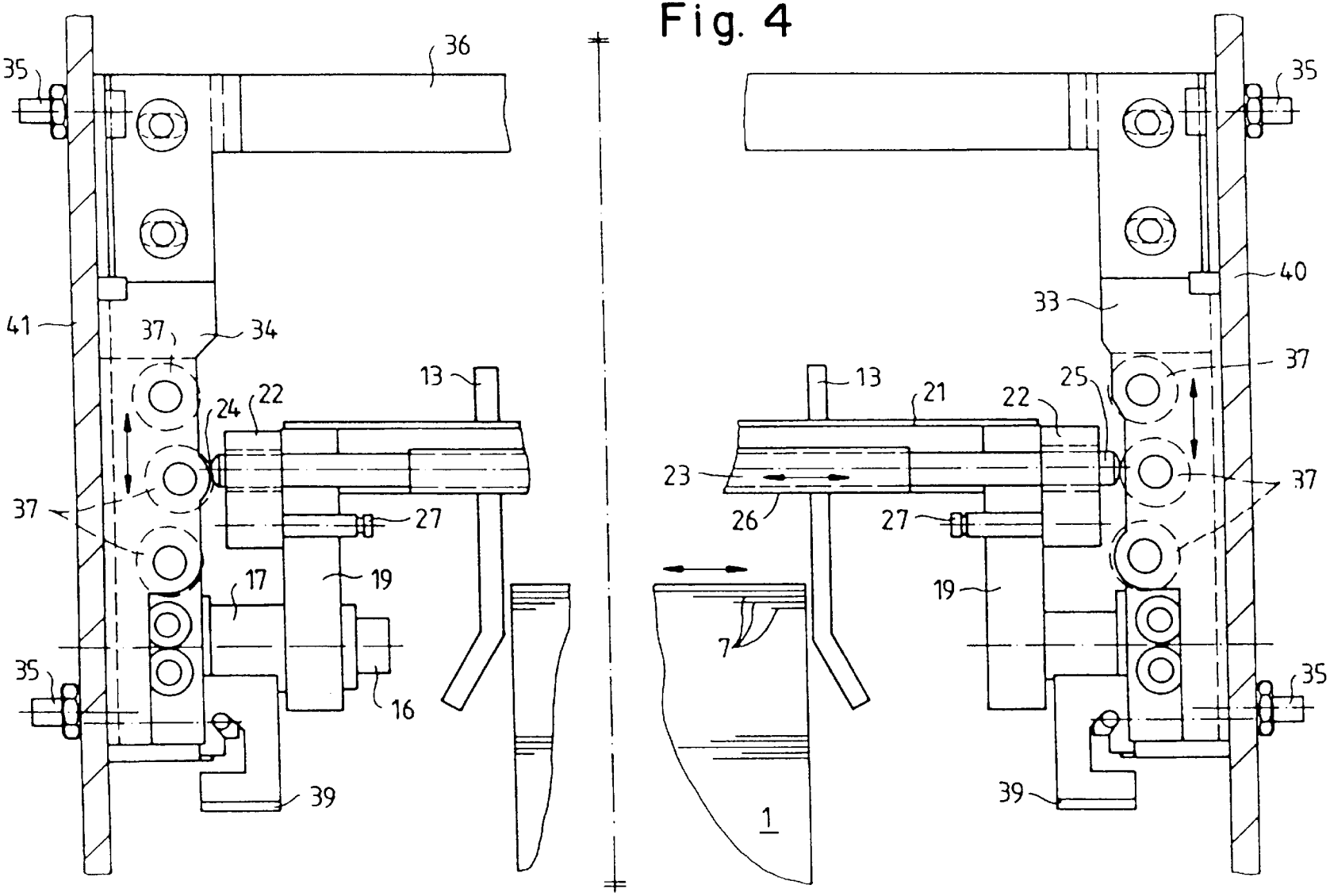
FIG. 4 is a reduced front view, as seen from the right-hand side of FIG. 2, showing the roller carriers displaceably mounted on side walls, together with swivelable levers.

FIG. 4 is a frontal view of the roller carriers held at the side walls, together with an aligning mechanism and side stops in the sheet pile region.

The side stops 13, which are to be positioned according to the format or size of the stock to be printed, are held on the cross-member 14 and the adjusting spindle 43 which, however, with the levers 19 in the swiveled position shown in FIG. 4, are concealed by the profiled or contoured cross-member 21. The upper single sheets 7 of the sheet pile 1 are between the lower ends of the side stops 13. The two roller carriers 33 and 34, rigidly connected through the intermediary of the yoke 36, are held in defined positions on their respective side walls 40 and 41 by the adjusting bolts 35. The locking pins 38 are held in the U-bolts 39; the roller carriers 33 and 34 are consequently locked. The double arrows in the respective vicinities of the roller carriers 33 and 34 indicate the vertical displaceability thereof.

The aligning member 23, which is provided with the friction coating 26, is axially displaceably guided in the bearings 22, which are rotatably held on the swivelable levers 19. The axial motion of the aligning member 23 is indicated by the horizontal double arrow associated therewith; likewise, the lateral aligning motion of the single sheets 7 at one of the two side stops 13 is so indicated. At the operating phase instant represented in FIG. 4, contact heads 24 and 25 of the aligning member 23 are passing the middle cylindrical bodies 37 held on the roller carriers 33 and 34. The aligning member 23 is thereby brought into a starting position.

In the course of the further downwardly directed swiveling motion of the levers 19 about the journals 17, the contact head 25 passes the lowermost of the projecting cylindrical bodies 37, due to which an axial displacement of the aligning member 23 in a direction towards the roller carrier 34 occurs. The aligning member 23 is able to be deflected in the axial direction, because the lower one of the cylindrical bodies 37 in the roller carrier 34 is disposed in a more receding position than is the upper one thereof. At the instant of commencement of the lateral aligning motion in the direction of the left-hand half of the double arrow, the friction coating 26 is in contact across its entire width with the uppermost single sheet 7. Promoted by the devices for fanning the single sheets 7, as outlined in greater detail in conjunction with FIG. 1, a lateral alignment of the single sheet 7 against the left-hand side stop 13 occurs.

After contact is made between the friction coating 26 and the uppermost single sheet 7, the swivelable levers 19 are moved farther towards the upper side of the pile, against the spring force acting at the journals 27, until the scanning bar 20, which is not shown in FIG. 4, touches the upper side of the sheet pile 1. In this manner, during one movement, both the lateral alignment of the uppermost single sheet 7 against the side stop 13 and also the detection of the height of the sheet pile 1 occur.

During the upwardly directed swiveling motion of the levers 19, the aligning member 23 is reset. This takes place as soon as the contact head 24 of the aligning member 23 comes into contact with the middle cylindrical body 37 of the roller carrier 34. The aligning member 23 is then moved towards the roller carrier 33. The lateral resetting motion of the aligning member 23 is limited by the contact head 25, which contacts the middle cylindrical body 37.

The hereinafore-outlined operations relate to lateral alignment against the left-hand side stop 13. of course, the lateral alignment of the single sheets 7 is likewise possible against the right-hand side stop 13.

For this purpose, the locking pins 38 on the roller carriers 33 and 34 are pulled out of the side walls 40 and 41 through the intermediary of the U-bolts 39. Thereafter, the roller carriers 33 and 34 are displaced vertically downwardly in the direction of the double arrows over a distance corresponding to the spacing between two cylindrical bodies 37. Thereafter, the roller carriers 33 and 34 are again fixed in position by the insertion of the locking pins 38. During the downwardly directed swiveling motion of the levers 19, the contact head 24 strikes the projectingly oriented cylindrical body 37 on the roller carrier 34. This results in the lateral displacement of the aligning member 23 towards the right-hand side stop 13. The single sheets 7 are thereby laterally aligned against the stop. Similarly, the aligning member 23 is reset to its starting position during the upwardly directed swiveling motion of the levers 19. Then, namely, the contact head 25 of the aligning member 23 strikes the upper cylindrical body 37 of the roller carrier 33. The aligning member 23 executes a lateral resetting motion towards the roller carrier 34. The resetting motion is limited by the striking engagement of the contact head 24 of the aligning member 23 with a cylindrical body 37.

It should be noted that, also in the case of this changed-over lateral alignment of the single sheets 7, the height of the sheet pile 1 is detected by the scanning bar, which is held in the swivelable levers 19.

FIGS. 5 to 7*a* show a further embodiment of the apparatus for sheet singling and alignment according to the invention. The pre-fanned sheets 7 are transferred to suckers 8 and are introduced into the nip between the two transport rollers 4 and 5, wherefrom they are then transferred to the otherwise non-illustrated printing press. Note that the fanning blower at the front or leading side of the sheet pile 1 is not shown separately in the drawing. Similarly to the previously described embodiment according to FIGS. 1 and 4, the uppermost sheet 7 of the sheet pile 1 in FIGS. 5 to 7*a* is aligned against one of the two side stops (which are not shown in these figures in the interest of clarity) as a result of a motion of the aligning member 23 in the axial direction. This motion takes place as soon as the aligning member 23 sets down on the uppermost sheet 7 of the sheet pile. The instant of triggering of the axial motion of the aligning member 23 as well as its resetting to its starting position is determined through the interplay of the end regions of the aligning member with the cams 46, which are positioned to the side of the sheet pile 1.

As also in the aforedescribed embodiment, so too in the additional embodiment shown in FIG. 5 are the swivelable levers 19 held on journal bearings 15 which, in turn, are held in the side walls 40 and 41 which are likewise not shown in this figure. The levers 19 themselves are in the form of metal parts and are interconnected through the intermediary of a tubular cross-member 45. The tubular cross-member 45, for one, assumes the function of scanning the height of the pile and, for another, connects the levers 19. This embodiment is characterized by the use of low-cost components; furthermore, the rigid connection of the levers 19 through the intermediary of the tubular cross-member 45 provides a torsionally rigid construction with low mass of the moving parts. Provided on the levers 19 are the swivelable bearings 22, which accommodate the aligning member 23 and the tubular cross-member 45. The contact force of the bearings 22 and thus the contact force of the aligning member 23 on the uppermost sheet 7 of the sheet pile 1 is adjustable through the intermediary of the diagrammatically represented spring 29. The contact pressure of the aligning member 23 is able to be adjusted by means of the knurled screw 32 in accordance with the stock to be processed.

By means of the adjusting mechanism 63, it is possible to make a fine adjustment of the contoured or profiled elements, in this case the cams 46. By rotation of the bolt 55, the cam 46 can be displaced vertically within a limited range. Through the vertical adjustment, which is in the order of magnitude of 1 mm, it is possible for the axial aligning motion of the aligning member 23 to be optimally matched to any grade of paper which is to be processed.

The sheets 7 of the sheet pile 1 are aligned either against the right-hand side stop 13 or against the left-hand side stop 13. In order to ensure problem-free changeover of the aligning motion towards the left-hand or right-hand side stop, the cam 46 is connected to a connecting linkage through the intermediary of a metal part 47. In particular, a lever 48 is attached to the metal part 47. A lever 51 is articulatingly connected to the lever 48 at the pivot point 49. The levers 51, disposed at either side of the sheet pile 1, are interconnected through the intermediary of a control shaft 52. Holes 53 are provided in this control shaft 52. By the rotation of the control shaft 52 through a given angle, the cams 47 are vertically displaced in such a manner that, due to the changed cam contour, which cooperates with the end regions of the aligning member 23, a changeover of the aligning motion of the aligning member 23 occurs. The metal parts 47 carrying the cams 46, and the cams 46 themselves, respectively, are formed with slots or oblong holes 57, 58, with bolts 59, 60 engaging in the oblong holes 57, 58 preventing tilting of the cams 46. A thrust bolt 50 in the pivot point 59 ensures the locking of the cams in one of the two end positions.

Attached to at least one of the cams 46 is an indicating or display apparatus 54, which indicates the current position of the cams 46, indeed both a coarse as well as a fine setting. The indicating device 54 is formed of a metal plate 54*a*, which carries a scale and is fixedly connected to the side wall 40, 41, and a pointer 54*b*, which is rigidly attached to the cam 46. The scale on the plate 54*a* is selected so that, firstly, it is possible to read against which side stop 13 the sheets 7 are being aligned; secondly, it is possible to read the fine setting with the desired accuracy, depending upon the thickness of the sheets 7 which are to be processed.

FIGS. 6 and 6*a* are longitudinal sectional views of the embodiment according to FIG. 5. The following remarks relate to FIG. 6*a*, which is an enlarged detail of FIG. 6. In particular, FIG. 6*a* shows the adjusting device with which the contact pressure of the aligning member 23 against the uppermost sheet 7 of the sheet pile 1 is adjustable. The swivelable lever 19 is held in a side wall 40, 41 by means of a journal bearing 15. Each journal bearing 15 has a respective bushing 18, which is bolted to one of the two side walls 40, 41. The journal 44 is axially fixed on a plain or slide bearing in the bushing 18. In order to attach the lever 19 to the journal 44, the lever 19 is provided with a rectangular cutout 19*a* which is held by a corresponding mating piece on the journal 44. By loosening the two bolts 16, it is possible to remove the device held in the side walls 40, 41, and made up of the levers 19, the tubular cross-member 45, the bearings 22 and the aligning member 23. The swivelable lever 19 accommodates a knurled screw 32. By actuation of the knurled screw 32, it is possible to adjust the contact pressure of the aligning member 23 on the uppermost sheet 7 of the sheet pile 1. The knurled screw 32 acts upon the spring 31, which is connected to the spring bolt 30*b*. A further spring 29 is attached between and to the spring bolts 30*a* and 30*b*. The spring bolt 30*a* is rigidly connected to the bearing 22. The bearing 22 is held on the journal of the tubular cross-member 45 and serves to accommodate the end regions of the aligning member 23. The tubular cross-member 45 is rigidly connected to the lever 19. The aligning member 23 carries rubber rings, which ensure contact with the uppermost sheet 7 of the sheet pile during the lateral aligning motion of the aligning member 23.

FIGS. 7 and 7*a* are frontal views of the embodiment according to FIG. 5. FIG. 7*a* is an enlarged fragmentary representation of FIG. 7 and serves hereinbelow for the description of the represented cams, the cooperation thereof with the aligning member 23 and the adjusting devices 56 and 63 for the lateral alignment and vertical adjustment of the preferred embodiment.

The two levers 19 are rigidly interconnected through the intermediary of the tubular cross-member 45. As already described hereinbefore, the tubular cross-member 45 further serves for scanning the height of the sheet pile 1. The journals of the tubular cross-member 45 accommodate the bearings 22. The end regions of the aligning member 23 are accommodated in the bearings 22. The rounded contact regions 25 of the aligning member 23 cooperate with the cams 46 when the levers 19 are swiveled. Each of the two cams 46 is vertically movable in a metal part 47 attached to the side wall 40, 41. The bolts 60 and 61 serve to guide the cams 46 in the slots or oblong holes 57, 58; they are not, therefore, firmly tightened, but merely finger-tightened.

The operating principle of the aligning member 23, particularly the axial displacement of the aligning member 23 when contact is made with the uppermost sheet 7 in the sheet pile 1 and thus the alignment of said uppermost sheet 7 against one of the side stops 13 as well as the resetting of the aligning member 23 during the swivel motion away from the sheet pile 1, has been thoroughly explained hereinbefore in conjunction with the embodiment shown in FIGS. 1 to 4. Because the contour of the cam represents an equivalent to the rollers that were offset in the roller carriers, no further details are given at this point, because they would constitute merely a repetition of what has already been stated.

Attached to the metal plate 47 is a lever 48 which, in turn, is articulatingly connected to a further lever 51 at the pivot point 49. The levers 51 are interconnected through the intermediary of a switching shaft 52, the journals of which are held in the side walls 40, 41. In order to provide for the rotation of the control shaft 52, openings 53 are provided which serve to accommodate a suitable tool. In order to ensure that one of the two end positions is attained for lateral alignment against the left-hand or right-hand side stop 13, a thrust bolt 50 (bolt with spring) is provided at the pivot point 49, the thrust bolt 50 forcing the control shaft 52 beyond dead center into the desired end position.

In addition to this change-over of the cams 46, which corresponds to a reversal of direction during the lateral alignment of the uppermost sheet 7 of the sheet pile 1, a fine adjustment of the cams 46 is also provided. As already mentioned, the purpose of such fine adjustment is to shift the timing of the lateral aligning motion of the aligning member 23 and thus to achieve optimal matching to the particular thickness of paper which is to be processed. Provided for this purpose is an adjusting mechanism 63, which causes the cam 46 to be moved in relation to the metal part 47. A projection 64 with a hole for accommodating the adjusting screw 55 is provided on the metal part 47. The adjusting screw is pinned to the lower part of the cam 46. The pin 65 limits the displacement travel between the cam 46 and the metal part 47.

An indicating or display device 54 is provided in order to indicate the current height setting of the cam 46 or, alternatively, of the roller carrier 33, 34. The indicating device 54 is formed of two parts: a metal plate 54*a* carrying a scale, and a pointer 54*b*. The metal plate 54*a* is formed as an angle rigidly connected to the side wall 40, 41, and cooperates with a pointer 54*b* which, in turn, is rigidly connected to the cam 46. The height setting, which can be read from the scale, indicates against which side stop 13 the single sheets 7 are being aligned and to which paper thickness the apparatus is currently set.

I claim:

1. Apparatus for sheet singling and alignment on a top side of a sheet pile of a rotary printing press, comprising a suction device extending transversely to sheet transport direction in the vicinity of the leading edge of the sheet pile, said suction device being intermittently activatable with suction air, a scanning device for scanning a height of the sheet pile, said scanning device extending across the entire width of the pile and having a member movable towards and away from the top side of the pile for scanning the height thereof, swivelable levers adjacent said pile-height scanning member, an element for laterally aligning single sheets of the sheet pile axially displaceably mounted on said swivelable levers, said element for laterally aligning the single sheets being shaped as a rod and being at least Partly provided with a friction coating, means for directing an air stream onto the leading edge of the sheet pile so as to lift off a leading-edge region of the respective single sheets from the pile, side walls, profiled elements mounted in said side walls, and rounded contact heads formed at respective end regions of said rod-shaped aligning element, said contact heads being in cooperative engagement with said profiled elements during a swiveling movement of said swivelable levers.

2. Apparatus according to claim 1, including a spring-loadable adjusting device for varying contact force between said aligning member and an uppermost single sheet of the sheet pile.

3. Apparatus according to claim 1, wherein said element for laterally aligning single sheets includes two side stops between which the single sheets in the upper region of the sheet pile are disposable, said side stops being positionable for matching the format of the respective single sheets.

4. Apparatus according to claim 1, wherein said profiled elements are roller carriers carrying a plurality of cylindrical bodies disposed above one another, at least one of said cylindrical bodies being offset with respect to an imaginary plane extending through the others of said cylindrical bodies.

5. Apparatus according to claim 4, including a yoke, said roller carriers being interconnected at said side walls through the intermediary of said yoke.

6. Apparatus according to claim 4, wherein two cylindrical bodies are disposed so as to protrude with respect to the vertical, on one of the roller carriers and, on another of the roller carriers, one cylindrical body is vertically protrudingly disposed with respect to the remaining cylindrical bodies.

7. Apparatus according to claim 1, wherein said profiled elements are cams.

8. Apparatus according to claim 1, including an adjusting mechanism for effecting a fine adjustment of said profiled elements in vertical direction.

9. Apparatus according to claim 1, including an adjusting unit for vertically displacing the profiled elements so that a lateral aligning movement of said aligning element is reversed.

10. Apparatus according to claim 9, wherein said adjusting unit is formed of connecting linkages respectively associated with the corresponding profiled elements, said connecting linkages being interconnected through the intermediary of a control shaft.

11. Apparatus according to claim 9, including an indicating element for indicating a current setting of said profiled elements.

12. Apparatus for sheet singling and alignment on a top side of a sheet pile of a rotary printing press, comprising a suction device extending transversely to sheet transport direction in the vicinity of the leading edge of the sheet pile, said suction device being intermittently activatable with suction air, a scanning device for controlling a lifting motion of the sheet pile, said scanning device extending across the entire width of the pile and having a member movable towards and away from the top side of the pile for scanning the height thereof, swivelable levers adjacent said pile-height scanning member, an element for laterally aligning single sheets of the sheet pile axially displaceably mounted on said swivelable levers, and means for directing an air stream onto the leading edge of the sheet pile so as to lift off a leading-edge region of the respective single sheets from the pile, wherein said pile-height scanning member has respective ends penetrating said swivelable levers, and including respective bearings mounted on said ends of said scanning member.

13. Apparatus according to claim 12, wherein said bearings support said aligning member, and are disposed so as to be rotatable about a center point of said scanning member.

* * * * *